United States Patent [19]

Sawant et al.

[11] Patent Number: 4,697,745

[45] Date of Patent: Oct. 6, 1987

[54] METHOD AND APPARATUS FOR HIGH PERFORMANCE CONICAL CRUSHING

[75] Inventors: Ulhas S. Sawant, Sussex; Vijia K. Karra, Greendale; Dean M. Kaja, Germantown, all of Wis.

[73] Assignee: Rexnord Inc., Brookfield, Wis.

[21] Appl. No.: 832,917

[22] Filed: Feb. 24, 1986

[51] Int. Cl.[4] ..... B02C 2/04; B02C 19/00

[52] U.S. Cl. ..... 241/30; 241/207

[58] Field of Search ..... 241/30, 207–216, 241/286, 290

[56] References Cited

U.S. PATENT DOCUMENTS

| | | | |
|---|---|---|---|
| 3,599,883 | 8/1971 | Pollack | 241/213 |
| 3,797,759 | 3/1974 | Davis et al. | 241/30 |
| 4,012,000 | 3/1977 | Davis et al. | 241/290 |
| 4,034,922 | 7/1977 | Coxhill | 241/213 |
| 4,147,309 | 4/1979 | Vroom | 241/215 |
| 4,477,031 | 10/1984 | Alford | 241/215 X |

OTHER PUBLICATIONS

"Hydrocone Crushers", Product Brochure by Allis--Chalmers.

*Primary Examiner*—Timothy V. Eley

*Attorney, Agent, or Firm*—Silverman, Cass, Singer & Winburn, Ltd.

[57] ABSTRACT

A conical crusher having a power draw of approximately 1,000 Hp and capable of being installed in a conventional crusher foundation is provided with an annular frame shell with support means capable of withstanding the higher than normal crushing forces, a hydraulic circuit capable of counterbalancing the crusher bowl while it is in a raised position to allow material to be cleared from a jammed crusher, and a mechanical anti-spin head bushing. A method is provided for increasing the production of conical crushers by altering head throw and diameter, increasing the power draw and increasing the internal volume of the crusher.

18 Claims, 6 Drawing Figures

METHOD AND APPARATUS FOR HIGH PERFORMANCE CONICAL CRUSHING

BACKGROUND OF THE INVENTION

The present invention relates to conical crushers, and, more specifically, discloses structural features which enable a conical crusher to operate with a power draw twice that of unit designed according to conventional standards, as well as a method of determining crusher design parameters for achieving optimum performance. Crusher performance refers to the total throughput of communited material, as well as to the average particle size of that material.

Generally, a conical crusher is comprised of a head assembly including a conical crusher head which gyrates about a vertical axis by means of an eccentric mechanism. The eccentric is driven by any one of a number of power drives. The exterior of the conical head is covered by a wearing mantle which actually enagages the material being crushed. Spaced from the head assembly and supported by the crusher frame is a bowl fitted with a liner comprising the opposing surface of the mantle for crushing the material, be it coal, ore, or minerals.

Conical crusher head have basically two operating orientations. The first or "no-load" occurs when no material is being introduced into the crusher, but the crusher must be kept running due to its inability to initiate the rotation of a stopped head against the force exerted by a hopper full of rock. In the "no-load" orientation, the crusher head rotates in unison with the eccentric.

The second, or "on-load" orientation occurs when material is introduced into the crusher. The force of crushing the feed material on the conical head causes it to rotate in a direction opposite that of the eccentric. Most crushers have some type of anti-spin or head braking device which slows the "no-load" rotational velocity of the head, due to the unsafe tendency of crushers to violently fling the first particles of material introduced, causing injury to operators and/or damage to the crusher.

Conventional anti-spin devices are not suitable for large crushers due to space requirements and are a costly addition to those smaller crushers that can accommodate them.

Current market considerations in the mining and aggregate industries have forced crusher operators to be more cost effective than in the past. This drive for greater efficiency has created a demand for conical crushers which consume significantly less energy per ton of crushed material per crushing station. Also, existing physical crusher support facilities should be utilized whenever possible when implementing cost effective-technology.

There are several aspects of a conical crusher which must be adapted to achieve the goal of increased production on an existing foundation. These include a crusher frame and shell design which can withstand the increased stress forces generated by a twofold increase in power without increasing external frame dimensions. Another area of concern is the hydraulic circuit, which must be capable of rapidly passing tramp material and resuming operation after clearing to minimize downtime. To achieve this latter goal, a hydraulic circuit is needed which positively secures the crusher bowl during crushing and allows the bowl to raise from, and lower to a previous operating position during a clearing cycle.

It is therefore an object of the present invention to provide a crusher of significantly increased capacity and power rating which can be installed on an existing crusher foundation.

It is a further object to provide a simplified antispin device capable of adequately restraining the "no-load" rotation of a conical head of a crusher.

It is another object of the present invention to provide an improved crusher frame shell design which possesses increased stress support while minimizing frame mass.

It is still another object of the present invention to provide a crusher hydraulic system having a counterbalance feature which holds the bowl elevated for clearing purposes, yet permits the hydraulic jack to completely retract once the bowl is returned to its normal operating position.

SUMMARY OF THE INVENTION

A conical crusher is provided which is designed to significantly increase the production of comminution installations. More specifically, a conical crusher equipped with modifications to increase both production capacity and power draw is designed to be installed on an existing crusher foundation.

The crusher of the present invention is comprised of a gyrating conical head assembly rotated in gyratory fashion by a driven eccentric. The head is supported and in a frame by a bearing socket mounted upon a stationary support shaft. Also supported by the frame is a vertically adjustable bowl which encircles the head assembly and provides a surface against which the conical head operates to crush incoming material. Hydraulic tramp release and jacking mechanisms are designed to achieve rapid resumption of normal operation. Design modifications to the head assembly, frame and hydraulic system allow the present crusher to increase production and operate under an increased power draw.

First, the outer shell of the crusher frame is specially designed to withstand the significant stress forces generated during crushing at twice the standard power draw, or on the order of 1,000 Hp, while minimizing the addition of costly structural supports. To achieve this end, the upper frame flange is gradually thickened towards the upper rim, where it forms a combined bowl support section and hydraulic tramp release cylinder support. Clearing jacks are also mounted on this flange.

Second, the hydraulic circuit operating the tramp release cylinders and the hydraulic clearing jacks is provided with a counterbalance valve. This counterbalance valve performs the dual function of holding the bowl in a suspended position during the clearing process and, once the bowl resumes its normal operating position, allowing the jack to assume a fully retracted position.

Third, a mechanical anti-spin upper head bushing is provided which slows the rotation of the head about its stationary support shaft when the crusher is in the "no-load" orientation. The anti-spin bushing frictionally engages the stationary head support socket in a cycle which directly resists the eccentric-generated gyrations of the conical head. When the crusher head assumes the "on-load" orientation, the anti-spin bushing is prevented from further engagement of the head support socket.

DESCRIPTION OF THE DRAWINGS

The novel features of the present invention will become more apparent upon a review of the drawings in which.

DESCRIPTION OF THE PREFERRED EMBODIMENT

Figure 1:
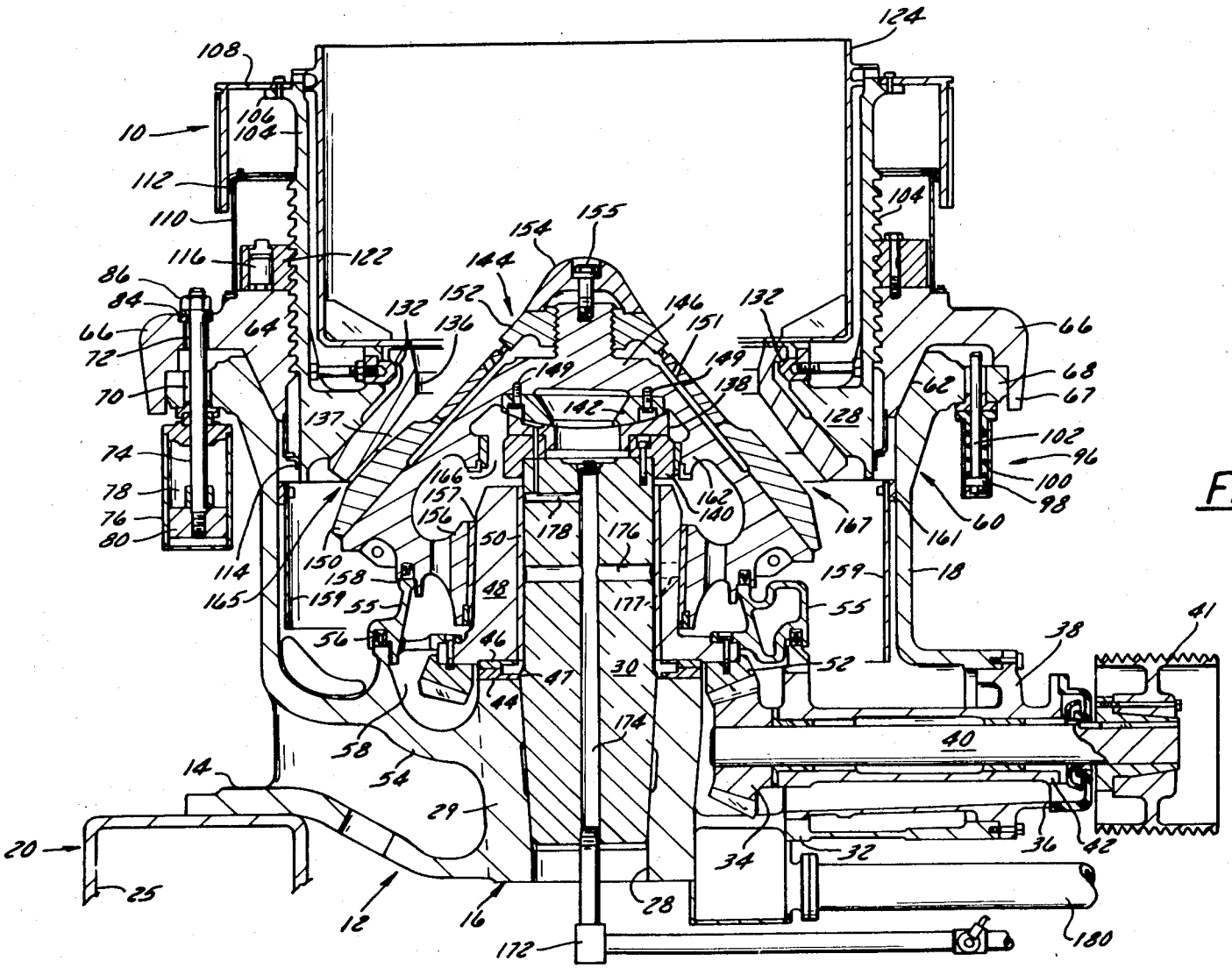
FIG. 1 is a side view in partial section of a crusher assembly of the present invention.

Referring now to the drawings, wherein like reference numerals designate identical features, a conical crusher 10 is depicted, comprised of a frame 12 having a base 14, a central hub 16 and a shell 18. The base 14 rests upon a platform-like foundation 20 which provides access to crushed material.

Figure 5:
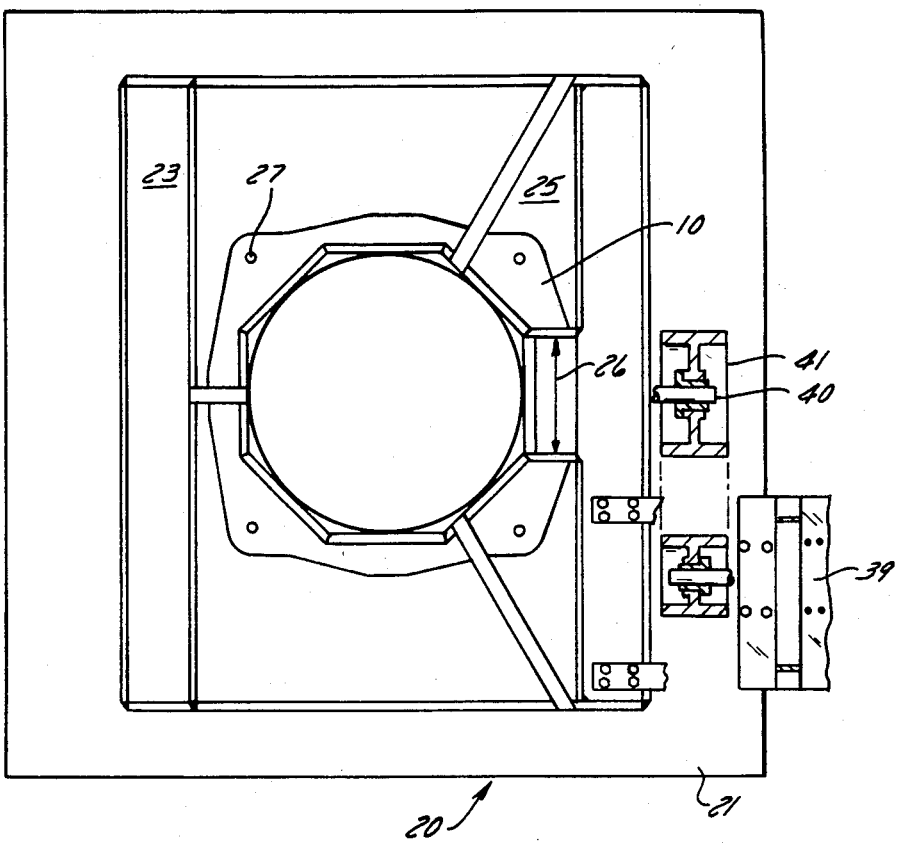
FIG. 5 is a plan view of the crusher foundation depicted in FIG. 4.
Figure 4:
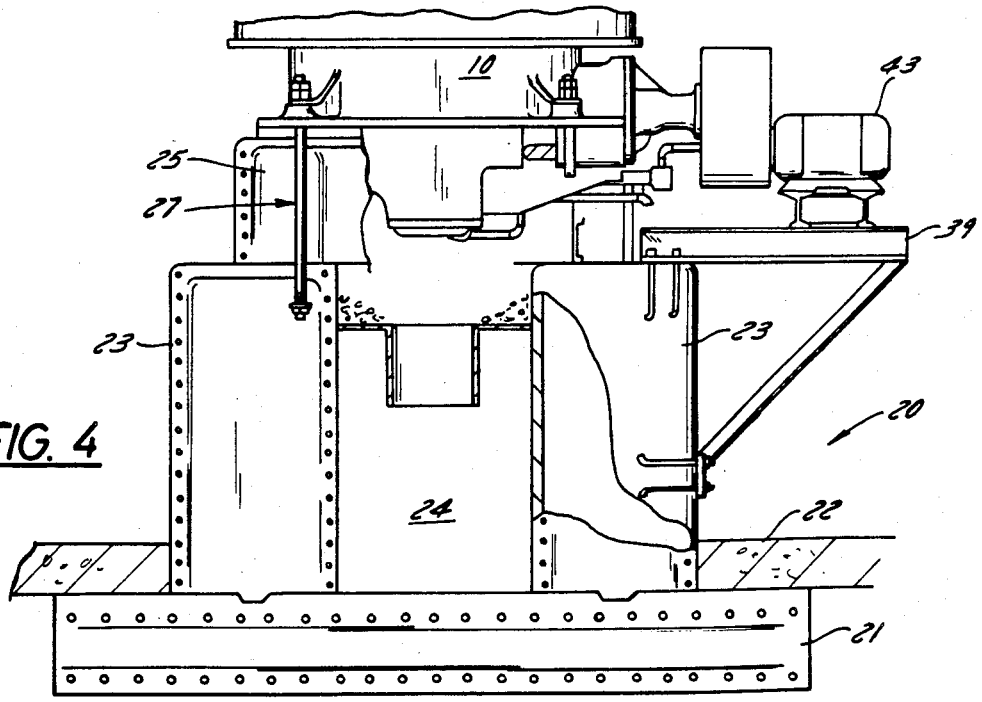
FIG. 4 is a side elevation of the crusher foundation of the present invention.

FIGS. 4 and 5 depict a common type of foundation 20 used with the present type of crusher. The foundation is comprised of a base 21 embedded below grade 22. Base 21, usually fabricated of concrete, supports a pair of concrete piers 23 separated by an access gap 24 into which is inserted a conveyor means (not shown) which collects and removes the crushed product. A 'C'-shaped foundation block 25 also made of concrete, is secured to the top of piers 23. Crusher 10 is placed upon block 25 so that countershaft 40 and drive pulley 41 are accommodated within opening 26. Anchor bolts 27 secure the crusher 10 to block 25 and piers 23. The crusher drive source 43 is located on platform 39, secured to piers 23.

In order to avoid the significant cost of modifying or rebuilding foundation 20 to accommodate a larger crusher, the present crusher 10 achieves a significantly increased production, while using the existing foundation 20. In the preferred embodiment, a seven foot crusher foundation is used, although the principles of the present invention may be applied to other foundation sizes.

Central hub 16 is formed by an upwardly diverging vertical bore 28 surrounded by a thick annular wall 29. The vertical bore 28 is adapted to receive a cylindrical support shaft 30. Extending outwardly from hub 16 is a housing 32 which encloses drive pinion 34. Supported by housing 32 and an outer seat 36 is a countershaft box 38 enclosing countershaft 40 and drive pinion 34, which rotate on bearings 42. In the preferred embodiment, sleeve bearings are employed. Countershaft 40 is provided with a pulley 41 connected by drive belts to a suitable drive source 43 capable of generating 1,000 HP.

Secured to the upper annular terminal surface 44 of wall 28 is an annular thrust bearing 47. An eccentric 48 is seated on horizontal surface 44 on the upper end of hub 26 by means of thrust bearing 46, and is rotatable about shaft 30 via annular inner bushing 50. An annular gear 52 is bolted to eccentric 48 and meshes with pinion 34. A flange 54 positioned about hub 16 and integral therewith, extends radially outwardly and curves upward, terminating adjacent the lower end of counterweight 55. Positioned between flange 54 and counterweight 55 is a seal 56 which may, for example, be of the labyrinth type as shown. Completion of hear well 58 except at the point of engagement of pinion 34 is provided by flange 54 which comprises a seat for the lower section of seal 56.

Frame 12 is further comprised of upwardly projecting annular shell 18 which is an integrally cast portion of frame 12. The lower portion of shell 18 is of substantially uniform thickness, but the upper portion 60 of shell 18 is thickened for reasons described in more detail below. The upper portion 60 of shell 18 terminates in part in a seat 62 for annular ring 64, and in an outwardly projecting flange 68 having a vertical bore 70.

Seat 62 supports an annularly shaped adjustment ring 64 positioned directly thereabove. Annular ring 64 is provided with an outward oriented flange 66 and a downward oriented shell 67. Flange 66 is provided with a plurality of vertical bores 72 corresponding to bores 70. Each pair of bores 70 and 72 are designed to accept the shaft 74 of one of a plurality of hydraulic tramp release cylinders 76, each comprised of an upper chamber 78 and piston 80.

Figure 3:
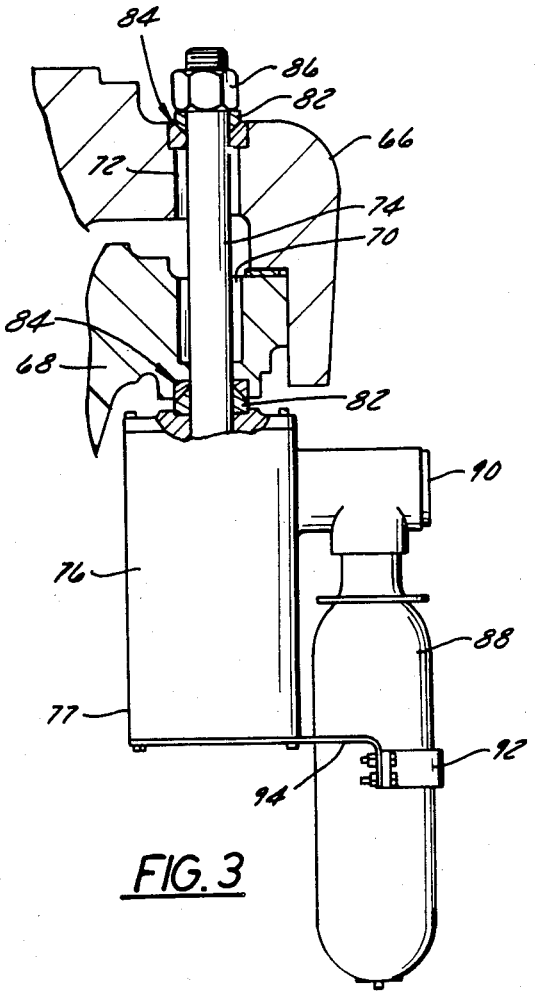
FIG. 3 is a side elevation in partial section showing the tramp release cylinder assembly of the present invention.

Now referring to FIG. 3, tramp release cylinders 76 are secured in bores 70 and 72 by means of a pair of cones 82, corresponding cups 84 and a threaded lock nut 86. An accumulator tank 88 is fitted to tramp release cylinder 76 via 'L'-fitting 90, and is secured thereon by strap 92 and mounting bracket 94. Mounting bracket 94 is attached to the base 77 of cylinder 76.

The function and operation of tramp release cylinders is well documented in the prior art, notably U.S. Patent 4,478,373. Essentially, during normal operation, fluid in upper chamber 78 holds piston 80 down, securing annular ring 64 to seat 62. When uncrushable tramp material is encountered in crushing gap 165, the ring 64 lifts on that side, causing shafts 75 to be raised and thus pulling piston 80 upward within the release cylinder 76. This causes the fluid to be forced from upper chamber 78 to the gas filled accumulator 88.

Once the obstruction is passed, piston 80 is pushed back to its normal position by the fluid returning from accumulator 88.

Since this tramp release apparatus must function while the crusher is in operation, it is critical that prolonged disruptions are avoided. By providing an accumulator 88 for each cylinder 76, and positioning that accumulator as close to each cylinder as possible, tramp release response time is significantly decreased.

Referring now to FIG. 1, flange 66 also serves as a stop for hydraulic clearing jacks 96. Jacks 96 are generally comprised of a housing 98, a hydraulic chamber 100, and a piston shaft 102, which divides chamber 100 into upper chamber 202 and lower chamber 214 (shown in FIG. 6).

It may be seen from FIG. 1 that the inner annular surface of adjusting ring 64 is helically threaded to receive a complimentary threaded outer annular surface of the crusher bowl 104. Rotation of bowl 104 thus adjusts the relative position thereof with respect to ring 64 and changes the setting of the crusher. The upper extension of bowl 104 terminates in a horizontal flange 106 to which is bolted a downwardly extending annular adjustment cap ring 108. To prevent the accumulation of material between the meshing threads of ring 64 and bowl 104, an annular dust shell 110 is bolted to ring 64 so that shell 110 is closely circumscribed by ring 108 in a telescoping relationship. Seal 112 is provided to completely enclose the volume. A second seal member 114 is secured to the undersurface of adjustment ring 64 and contacts the lower extension of bowl 104, thus preventing upward entry of material into the area between the threads.

Clamping ring 122, which is threadedly engaged around bowl 104, is provided with a plurality of hydraulic clamping cylinders 116 contacting ring 64 which is also threadedly engaged around bowl 104, the precise number of these cylinders being a matter of choice. Cylinder 116 normally biases ring 64 and bowl 104 into a tightly-threaded engagement so as to prevent axial and radial movement of bowl 64 when the crusher assembly is in operation.

Resting on the top surface of flange 106 is material feed hopper 124. Hopper 124 extends into the opening enclosed by bowl 96 and is provided with a central opening 126 for egress of material into the crusher. Bowl 104 additionally has a converging frustoconical extension 128 which converges upward from the lower end thereof. Seated on the top surface of extension 128 are wedges 132 which are designed to secure bowl liner 136 to bowl 104.

Cylindrical support shaft 30 extends above eccentric 48 and supports socket or spherical seat 138 which includes base portion 140. Seated against seat 138 is spherical upper bearing 142 which supports the entire head assembly 144.

Figure 2:
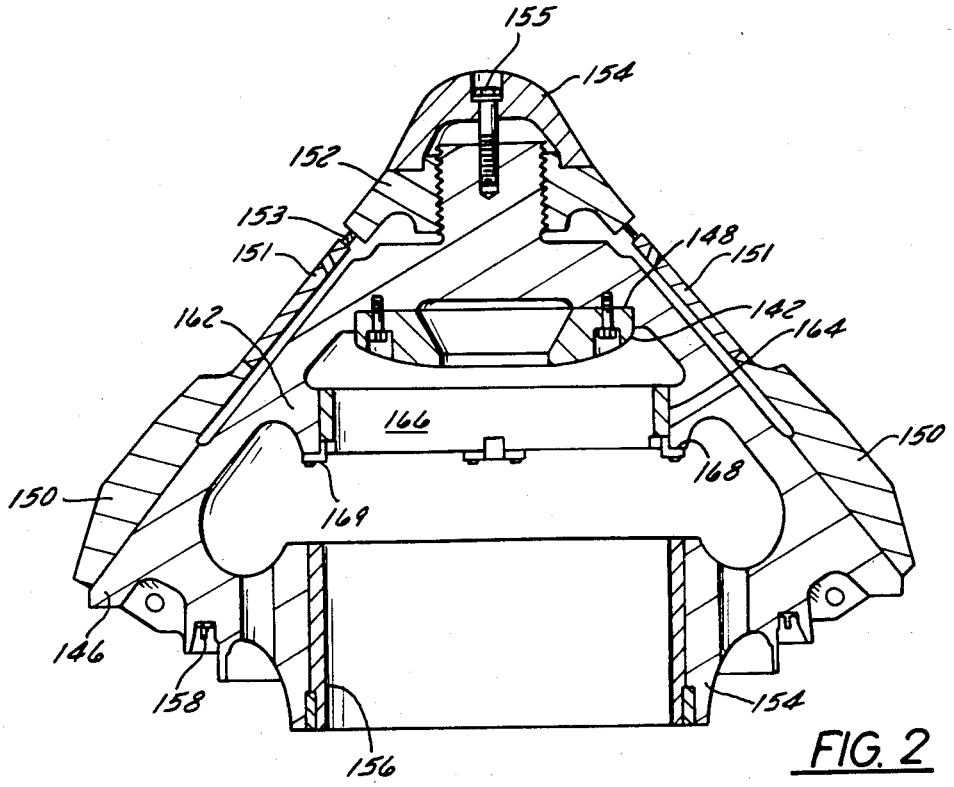
FIG. 2 is an enlarged side view in partial section, showing the conical crusher head assembly of the crusher shown in FIG. 1.

Referring to FIG. 2, head assembly 144 is comprised of conical head having an upper flange 148 to which is mounted bearing 142 via bolts 149. Secured to the exterior of head 146 is a lower mantle 150 and an upper mantle 151. Lower mantle 150 performs the major share of crushing by forcing material through a narrowed gap 165 formed between mantle 150 and bowl liner 136. Upper and lower mantles 150 and 151 are pressed together via locknut 152, threaded onto the top of head 146. A torch ring 153 is secured between locknut 152 and upper mantle 151 for ease of disassembly. Cap 154 protects locknut 152 and cap bolt 155 secures cap 154 to head 146.

Extending inwardly of head member 150, a follower 156 having a lower head bushing 157 is disposed around and engaging the outer surface of eccentric 48. A seal 158 is positioned between follower 156 and counterweight 55.

As may be seen in FIG. 1, the shape of the counterweight 55 is designed to compensate for the mass eccentricity of eccentric 48 and head assembly 144 so that the assembly of eccentric 48, counterweight 55 and head assembly 144 is balanced to produce no net horizontal forces on the foundation when the mantle 150 is half worn. Seals 158 and 56 are designed to compensate for the gyrations of head 150 so that the infiltration of dust into head cavity 160 is prevented.

To further reduce wear on the inside of the shell 18, a flexible polymeric curtain 159 is mounted to a plurality of spacer blocks 161 which in turn are secured to the inside wall of shell 18 by welding. The flexibility of the curtain and its spaced relation to the inside wall of the shell allows it to perform a shock absorbing function. The curtain protects the interior of shell wall 18 by absorbing the force of impacting discharge material.

Lubrication is supplied to the crusher assembly through an oil inlet line 172 which communicates with main oil passage 174 formed in shaft 30. Lubricant is provided to eccentric bearing 50 via passage 176 which extends on both sides of passage 174 and through passage 177 to the head bushing. Additionally, lubricant penetrates into the space between bearings 138 and 142 via passage 178. A drain 180 is provided to remove oil draining from pinion 34, eccentric 48 and bearing 138.

OPERATIONAL PRINCIPLES OF CONICAL CRUSHERS

In order to achieve the present goal of significantly increasing cone crusher production on an existing crusher foundation without increasing external crusher dimensions, several established parameters must be considered. First, cone crusher productivity is limited by volume, crushing force and power, any of which can be a limit for a particular crushing application. The basic relationship of crushing energy utilization for a given head may be expressed by the formula $$KWH/T \cdot P_{80} = K \text{ (a constant)}$$

where KWH=kilowatt-hours of energy consumed, T=tons of material processed by the crusher and $P_{80}$=80% passing size of the crushed product.

Given a feed material of fairly uniform consistency and size characteristics, at a constant product gradation crusher setting ($P_{80}$ is constant), as power KW is increased, to keep the equation in balance, production in terms of tons (T) per hour will proportionately increase. Alternately, if tonnage (T) per hour through the crusher remains constant, product size ($P_{80}$) can be reduced.

However, increases in crusher production are not unlimited, due to constraints on the volumetric ability of the crushing cavity to transport feed material, and the crushing force. The latter is expressed in terms of the maximum force in the crushing cavity 165 that can be sustained without resulting in a lift of ring 64 off frame seat 62 against the holding force of the release cylinders 76. In the present invention, the exterior volume of the crusher is finite since an existing crusher foundation is to be used. Thus the challenge was to increase the volumetric and force limits within this limited space.

Production volume may be increased by increasing the diameter and throw of head 146. A larger diameter head will increase the amount of materials crushed. The "throw" of head 146 is a common reference to the displacement of head 146 between the widest opening at 167 and the narrowest point at 165. Throw is dependent on crusher size, and is altered by changing the eccentricity of the eccentric 48. By increasing the throw, gap 167 becomes wider, allowing the passage of more material and consequently achieving more production. Volume may also be increased by altering the design of the liner 136 to accommodate more material at point 137 before the crushing action takes place at 165. In the present invention, inside diameter of liner 136 has been adjusted to increase the area of the gap at 137.

For a given crusher, crushing force varies in direct proportion to power drawn at a given crusher setting. Thus, as power draw is increased, crushing force increases proportionately. In cases where an operator desires a finer product, the setting is tightened. This tighter setting requires additional power to achieve equivalent production rates. Additional power can be drawn by proportionately increasing eccentric speed.

A corresponding increase in crushing force capability was accomplished by designing the tramp release cylinder hold down force 75% greater than would conventionally be required and then designing all structural and mechanical components consistant with this higher force limit. Tramp release cylinder force sets the limit of acceptable crushing force and limits the load transferred to other components.

Comparing the present invention with the design parameters of a conventional 7 foot conical crusher, if greater production at a given setting is desired, the head diameter is increased on the order of 10%, the throw is increased on the order of 40%, and the liner has been redesigned to accommodate on the order of 20% more production.

In the alternative, if a higher proportion of produced fines is desired, the diameter of bowl liner 136 is reduced below the preset level but within the maximum permitted for crusher operation, the head throw is decreased approximately 50%, the gyrational speed of the head is increased up to 100% over the preset level, and, as stated above, the crusher setting is decreased or narrowed. The fineness of the product can be increased by narrowing the setting to the minimum setting possible, or when the lower margin of bowl liner 136 begins to "bounce" or generate vibrations in the area of ring 64. The gyrational speed is increased up to a power draw on the order of 1,000 Hp. Thus, the greater amount of power drawn is channeled into the production of a finer product.

These parameters can also be used to yield greater volumes of a finer product by increasing the diameter of the head and bowl liner, increasing the throw, increasing the gyrational speed above preset levels to a level well below the maximum permissable speed level dictated by the lubrication requirements of the crusher's internal components, and decreasing the setting to the desired level of fineness. As in the previous examples, power draw may be on the order of 1,000 Hp.

In other words, the increased capacity and power draw of the present invention may be used to increase production at a given setting, to produce a greater percentage of fines at the lowest possible setting or to increase production of a slightly larger than finest product by adjusting head throw and liner diameter.

ANTI-SPIN HEAD BUSHING

Head 150 is further provided with an annular upper head bushing support 162 projecting inwardly into cavity 160 towards seat base or socket 140. Bushing support 162 has a flat facial portion 164 to which is mounted annular upper head bushing 166. Upper head bushing 166 is made of relatively ductile material, such as brass or bronze. Secured to support 162 by an interference fit and keys 169 inserted between bushing 166 and face 168, the upper head bushing is dimensioned to rotationally engage seat base 140 only when the crusher is running "no-load", and this engagement will tend to retard excessive head spin generated by the action of eccentric 48.

During normal crushing operation, the force of crushing rock at point 165 will position the bushing clearances such that there is no contact between upper head bushing 166 and the socket base 140. However, if rock is not being crushed, there is no force at position 165 and the centrifugal force of the rotating head mass will orient the bushing clearances such that the upper head bushing 166 will contact socket base 140 at a point 180° opposite point 165 on the head. If bushing 166 is not provided, head 146 has a tendency to accelerate to almost maximum eccentric speed. This accelerated condition of head 146 makes it difficult to introduce feed to the cavity 126.

A further benefit of the present upper head bushing is to prevent the head assembly from rolling off the socket liner due to the dynamic centrifugal forces generated while running "no-load".

Conventional means of spin retardation, such as the one-way clutch disclosed in commonly assigned U.S. Pat. No. 4,478,373, is inadequate to effectively retard the rotation of the present head, due to the size limitations of that mechanism compared to the large torque requirements for the present crusher. The present upper head bushing provides an uncomplicated yet structurally adequate solution to this inherent problem of conical crushers.

Once feed is introduced into the crusher 10, the force of the material being crushed will cause the head 146 to rotate in reverse direction to the eccentric. The load forces on the "crushing position" portion of the head will prevent the upper head bushing 166 from engaging socket base 140 during any portion of the rotational cycle whatsoever. Consequently, the upper head bushing will retard the rotation of the head *only* in the "no-load" position.

CRUSHER FRAME SHELL

In an effort to significantly increase crusher capacity on an existing crusher foundation, it was impossible to accommodate increased crushing power by using a wider based frame. Unfortunately, this design requirement eliminated the main structural advantage of wide-based frames, that being the relative ease of resisting crushing loads at acceptable stress levels. With the significantly increased power of the present invention, proportionately greater loads generated by the crushing operation are concentrated in the frame shell 18 and must be resisted.

During crushing operation, loads are generated in the bowl 104, particularly in the vicinity of the crushing cavity 185. In addition, tramp release cylinders 76 generate stress loads from the clamping force they exert on annular ring 64.

In response to these support needs, the present crusher frame shell 18 is provided with a substantially thicker cross section. Furthermore, the upper portion 60 of frame shell 18 is provided with a gradually outwardly flaring contour to reduce the above-identified stress loads. In the preferred embodiment, the angle of the flare approximates the angle of incline of the annular ring seat 62. This configuration was not the result of an obvious design choice, but was arrived at after serious analysis of the factors of crusher unit weight, cost of production, and support requirements of the tramp release cylinder.

HYDRAULIC CIRCUIT

Figure 6:
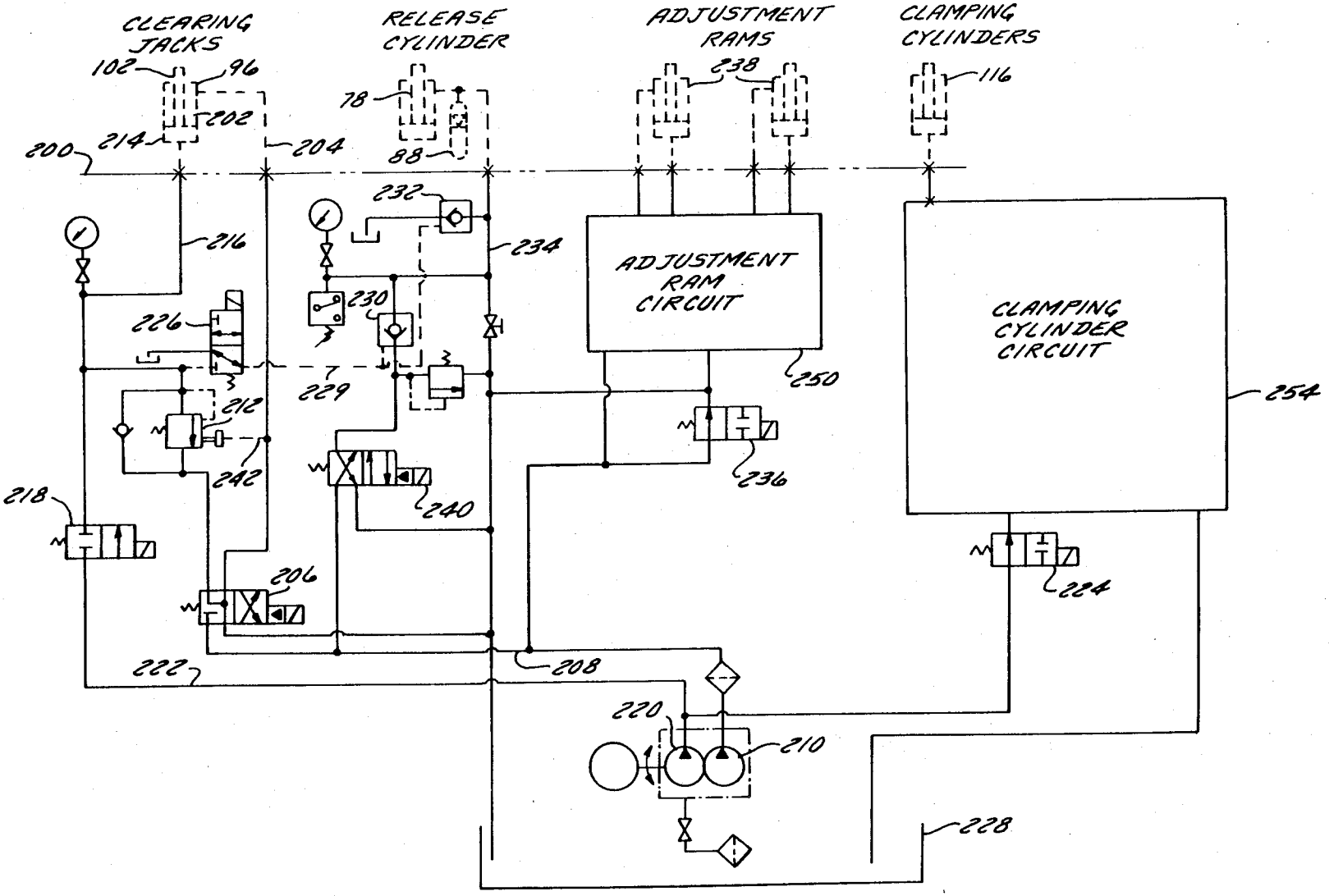
FIG. 6 is a hydraulic schematic of the system employed in a crusher of the present invention.

Referring now to FIG. 6, the specifics of the hydraulic control circuit may be viewed. The circuit as shown is employed with the tramp release cylinders 76, the clearing jacks 96, the clamping cylinders 116 and the rams 238 for effecting bowl adjustment. Separate circuitry may be employed as desired, however, it is more economical to use a single integrated hydraulic circuit.

The present invention concerns that portion of the circuit pertaining to the control of clearing jack 96 and tramp release cylinder 76 which is seen in the left hand portion of FIG. 6. To maintain the simplicity and clarity of the drawings and description, only a single jack 96, cylinder 76 and accumulator tank 88 are shown. In addition, adjustment ram circuit 250 and clamping cylinder circuit 254 are of conventional design. As such, they are represented in block diagram form only.

The upper chamber 202 of clearing jack 96 is depicted above piston 102 and communicates via line 204 through spring-loaded solenoid valve 206 into line 208 with 11.2 GPM pressure source 210. Line 204 is also connected to counterbalance valve 212, to be discussed in greater detail below. Lower chamber 214 is vented by line 216 through a spring-loaded solenoid check valve 218 normally biased in the closed position. Line 216 is also connected to counterbalance valve 212. Solenoid 218 is connected to 1.6 GPM pressure source 220 via line 222.

When it becomes necessary to raise adjustment ring 64 for clearing purposes, spring-loaded solenoid valve 224 is activated to prevent the return of oil back to storage reservoir 228 and to pressurize the system. Next, solenoid valve 218 is activated, allowing lower chamber 214 to pressurize, raising piston 102 and elevating ring 64. In addition, solenoid 226 is activated, allowing hydraulic fluid to pressurize the pilot lines 229 of pilot operated valves 230 and 232, opening these valves. This relieves the pressure on tramp release cylinder 76 and allows oil to drain to reservoir 228.

Once ring 64 is in the elevated position, it often must remain there for an extended period of time until the crusher is cleared of material. For this reason, it is beneficial to have some means of maintaining pressure in chamber 214 and line 216. In the preferred embodiment, this means is counterbalance valve 212.

Counterbalance valve 212 is preset to accommodate the combined load generated by the weight of annular ring 64 and bowl 104, residual pressure in upper chamber 202, and any residual clamping force exerted by tramp release cylinder 76. In the preferred embodiment, the counterbalance value 212 is set at approximately 2500 psi. If pressures on line 216 exceed preset levels, counterbalance valve 212 is designed to release pressure on the system by allowing fluid to flow through solenoid valve 206 and line 234 back to tank 228. This return flow of hydraulic fluid causes the annular ring 66 and bowl 104 to slowly descend.

Once clearing is complete, annular ring 64 is lowered to its normal operating position in the following manner. First, solenoid 236 is activated to energize line 208 as well as the hydraulic adjustment rams 238. Rams 238 function to adjust the setting of bowl 104 by rotating it within the helical threads of annular ring 66. They are described in detail in commonly assigned U.S. Pat. No. 3,570,774 to Gasparac, et al.

Next, solenoid 240 is activated to pressurize the upper chamber 79 of tramp release cylinder 76. This action generates a clamping force on ring 64 which adds to the weight on the clearing jacks 96. Lastly, solenoid 206 is energized to pressurize line 204, and chamber 202 of jack 96.

Referring now to FIG. 1, when descending ring 64 engages seat 62 of seat flange 68, the underside of the ring will engage the top of piston 102 unless the piston is fully retracted. If unremedied, this condition will cause excessive wear to the top of piston 102. The complete retraction of piston 102 is achieved by counterbalance valve 212 through connection 242. Pressure in lines 204 and 242 acts to open the counterbalance valve, thus releasing the pressure in the bottom chamber 214 of the clearing jacks, allowing them to fully retract.

Thus, the present invention discloses a method of significantly increasing conical crusher productivity by doubling power draw, and increasing head throw, head diameter and crushing cavity capacity. An improved crusher is provided which embodies design features intended to withstand and accommodate the stress forces generated by a power draw on the order of 1,000 Hp. These features include a head braking device, improved frame geometry, tramp release cylinders with adjoining accumulator tanks, and the use of a counterbalance valve in the hydraulic circuit.

While particular embodiments of the present invention have been shown and described, it will be obvious to persons skilled in the art that changes and modifications might be made without departing from the invention in its broader aspects.

What is claimed is:

1. A method for increasing the productivity of a conical crusher for communiting a volume of material over unit time, said crusher having a fixed outer configuration, a fixed bowl liner having a maximum diameter, a specific volumetric capacity, a conical head with a specified diameter and gyrating within said bowl liner at a specified throw, said head also having a specified gyrational speed and power draw, and said crusher having a specified setting or gap between said bowl liner and said head, with the crushing action taking place when the gyrating head moves toward the bowl liner, said method comprising:

increasing said throw of said head over the specified throw; and increasing said gyrational speed over the specified speed.

2. The method defined in claim 1 comprising replacing said head with a head having a diameter on the order of 10% greater than said specified head diameter.

3. The method defined in claim 1 comprising increasing said throw of said head on the order of 40% over said specified throw.

4. The method defined in claim 1 comprising replacing said bowl liner with a bowl liner having a volumetric capacity on the order of 20% greater than said specified volumetric capacity.

5. The method defined in claim 1 comprising increasing said power draw on the order of 100% over said specified power draw.

6. The method defined in claim 5 wherein said increased power draw is on the order of 1,000 HP.

7. The method defined in claim 1 comprising replacing said head with a head having a larger maximum diameter and replacing said bowl liner with a liner having a larger corresponding diameter without changing the size of said outer configuration of said crusher.

8. The method defined in claim 1 further comprising replacing said bowl liner with a bowl liner having a volumetric capacity greater than said specified capacity.

9. A method for increasing the productivity of a conical crusher for communiting a volume of material over unit time, said crusher of the type having a fixed outer configuration, a fixed bowl liner having a maximum outer diameter and a specified volumetric capacity and a conical head with a specified peripheral diameter and gyrating within said bowl liner at a specified throw, as well as a specified gyrational speed and power draw, said crusher having a specified setting or gap between said bowl liner and said head, with the crushing action taking place when the gyrating head moves toward the bowl liner, said method comprising;

replacing said head with a head having a diameter approximately 10% greater than said specified peripheral diameter;

increasing the throw of said head on the order of 40% greater than said specified throw;

replacing said bowl liner with a bowl liner having a volumetric capacity on the order of 20% greater than said specified volumetric capacity; and increasing said power draw to a level on the order of 1,000 Hp.

10. The method defined in claim 9, further comprising providing an existing 7 foot crusher foundation for said crusher.

11. A method for increasing the fineness of material communited in a conical crusher, said crusher having a fixed outer configuration, a fixed bowl liner with a specified diameter, a conical head gyrating within said bowl liner with a specified peripheral diameter and at a specified throw, gyrational speed and power draw, said crusher having a specified setting or gap between said bowl liner and said head, with the crushing action taking place between the head and the bowl liner, said action commencing when the gyrating head moves toward the bowl liner, said method comprising:

drawing a level of power not exceeding the maximum permissible power draw;

replacing said liner with a liner having a diameter less than said specified diameter;

decreasing said throw of said head below the specified throw;

increasing said gyrational speed of the head above the specified gyrational speed; and narrowing the crusher setting below the specified setting.

12. The method defined in claim 11 comprising reducing the head throw by up to 50% of the specified setting and increasing the head gyrational speed by up to 100 percent of the specified speed.

13. The method defined in claim 12 wherein the crusher setting is narrowed from said specified setting to the minimum permissible operational gap between said head and said bowl liner.

14. The method defined in claim 11 wherein the level of power draw is on the order of 1,000 Hp.

15. A method for increasing the volume and fineness of material communited by a conical crusher over specified volumetric and fineness values, said crusher having a fixed outer configuration mounted upon a foundation, a fixed a bowl liner with a specified diameter and a conical head having a specified diameter and gyrating within said bowl liner with a specified peripheral diameter and at a specified throw, gyrational speed and power draw, said crusher having a maximum gyrational speed and having a specified setting or gap between said bowl liner and said head, with the crushing action taking place between the head and the bowl liner when the gyrating head moves toward the bowl liner, said method comprised of:

drawing a level of power not exceeding the maximum permissible power draw;

replacing said liner and head with a liner and head having diameters greater than said specified diameters;

increasing the throw of said head over the specified throw;

increasing the gyrational speed of the head above the specified speed to a level well below the maximum permissible speed; and adjusting or narrowing the crusher setting to increase the amount of fines over the specified setting.

16. The method defined in claim 15 wherein the power draw is of the order of 1,000 Hp.

17. The method defined in claim 16 wherein the crusher is mounted upon the foundation of a conventional 7 foot conical crusher.

18. The method defined in claim 15 wherein increased production of a coarser product is achieved by widening the setting over the specified setting.

* * * * *